US006616483B2

(12) United States Patent
Matsumoto et al.

(10) Patent No.: US 6,616,483 B2
(45) Date of Patent: Sep. 9, 2003

(54) FUNCTIONAL CONNECTOR

(75) Inventors: Yoshifumi Matsumoto, Hisai (JP); Yoshiaki Matsutani, Hisai (JP); Kyouzou Hayashi, Hisai (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/141,770

(22) Filed: May 10, 2002

(65) Prior Publication Data

US 2002/0168899 A1 Nov. 14, 2002

(30) Foreign Application Priority Data

May 11, 2001 (JP) ..... 2001-141096

(51) Int. Cl.[7] ..... H01R 13/66
(52) U.S. Cl. ..... 439/620
(58) Field of Search ..... 439/620–622

(56) References Cited

U.S. PATENT DOCUMENTS 4,997,393 A * 3/1991 Armando ..... 439/620
5,139,443 A * 8/1992 Armando ..... 439/620
5,403,203 A * 4/1995 Fischl et al. ..... 439/620
5,924,899 A * 7/1999 Paagman ..... 439/620
6,010,366 A * 1/2000 Tanigawa et al. ..... 430/620

* cited by examiner

*Primary Examiner*—Gary Paumen
(74) *Attorney, Agent, or Firm*—Smith, Gambrell & Russell, LLP

(57) ABSTRACT

A functional connector includes: first, second and third lead frames each including a contact and a terminal integrally contiguous to the contact; a diode chip; a lead chip posed between the first lead frame and the second lead frame to connect opposite poles of the diode chip to the contact of each of the first lead frame and the second lead frame; a resistor chip arranged astride the second lead frame and the third lead frame and connected to the contact of each of the second lead frame and the third lead frame; and resin covering the first lead frame and the third lead frame each excluding the contact, the diode chip and the resistor chip, with the first lead frame and the third lead frame each having the terminal protruding externally.

6 Claims, 2 Drawing Sheets

FUNCTIONAL CONNECTOR

BACKGROUND OF THE INVENTION

1. Field of the Invention

The present invention relates to functional connectors for use for example with electrical equipment mounted to a vehicle.

2. Description of the Background Art

As vehicles are functionally enhanced they have a variety of electrical equipment mounted thereto. Furthermore such equipment varies from vehicle to vehicle. On the other hand, sharing a unit controlling electrical equipment is promoted to reduce cost. To allow the common control unit to control a variety of electrical equipment a functional connector is used to functionally complement the control unit.

The functional connector can include a diode connector, a resistor connector, a filter (capacitor) connector, and the like.

The diode connector is used to address an electric current turning around (or uniforming an electric current in direction). The resistor connector is used for adjusting a load resistance (or controlling an electric current in value). The filter (capacitor) connector is used to reduce noise.

The aforementioned functional connector, as described above, can accommodate a single required function. However, the functional connector alone cannot accommodate an electric current uniform in direction and controlled in value simultaneously.

If an electric current needs to be uniform in direction and controlled in value simultaneously the diode connector and the resistor connector would both be required.

Furthermore each needs to include male and female connectors, for a total of four connectors. This requires a large space for attaching them and is thus against demands for miniaturizing a component mounted to an automobile, reducing it in weight, and saving space.

Furthermore, if space-saving and miniaturization are attempted by combining a diode chip and a resistor chip, heat generated by the diode chip may negatively affect the resistor chip.

SUMMARY OF THE INVENTION

The present invention has been made to overcome the above disadvantages, with a functional connector serving both a diode connector and a resistor connector.

The present functional connector includes: first, second and third lead frames each including a contact and a terminal integrally contiguous to the contact; a diode chip; a lead chip posed between the first lead frame and the second lead frame to connect opposite poles of the diode chip to the contact of each of the first lead frame and the second lead frame; a resistor chip arranged astride the second lead frame and the third lead frame and connected to the contact of each of the second lead frame and the third lead frame; and resin covering the first lead frame and the third lead frame each excluding the contact, the diode chip and the resistor chip, with the first lead frame and the third lead frame each having the terminal protruding externally.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
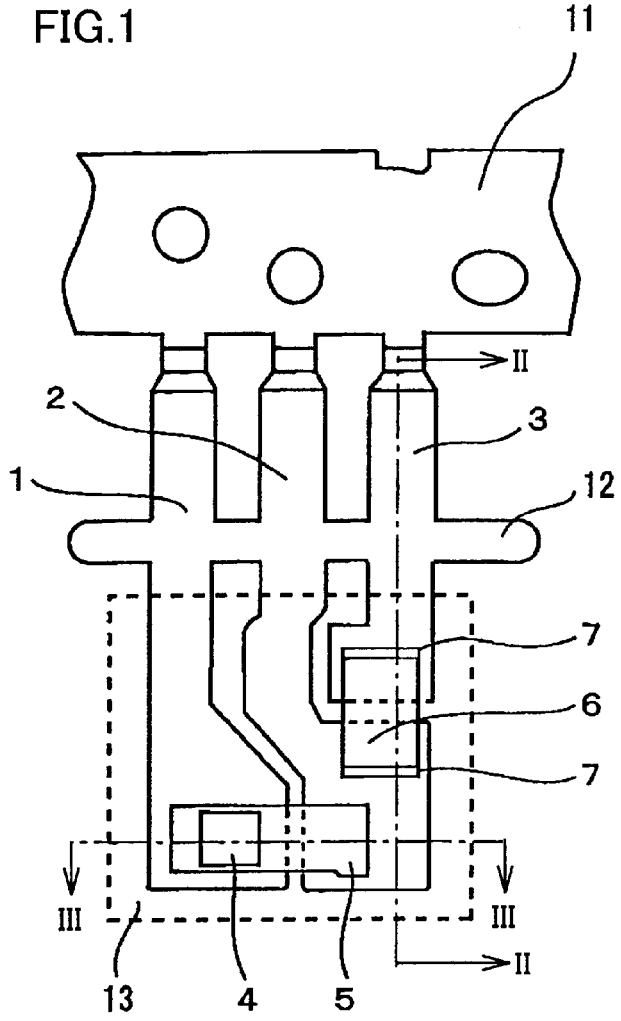
FIG. 1 is a plan view of a functional connector of the present invention in fabrication.
Figure 2:
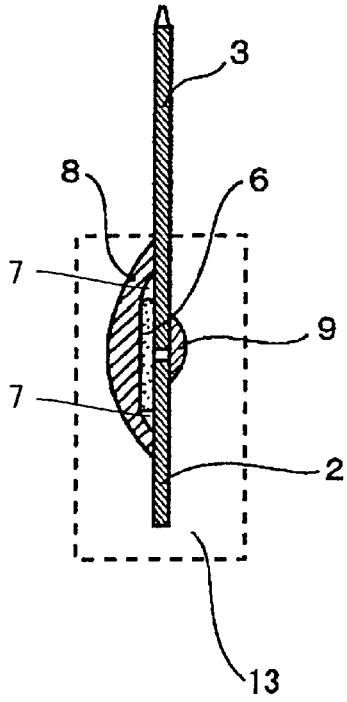
FIG. 2 is a cross section of the FIG. 1 connector taken along a line II—II.
Figure 3:
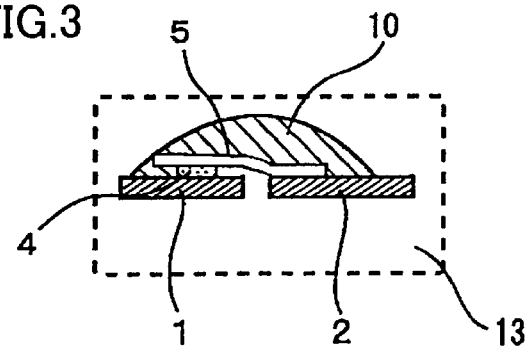
FIG. 3 is a cross section of the FIG. 1 connector taken along a line III—III.
Figure 7:
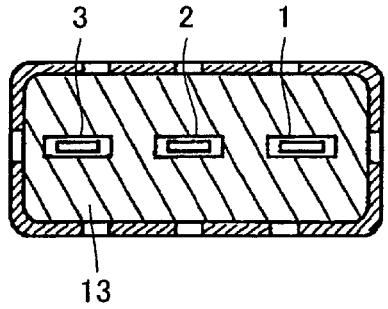
FIG. 7 is a cross section of the FIG. 4 connector taken along a line VII—VII.
Figure 4:
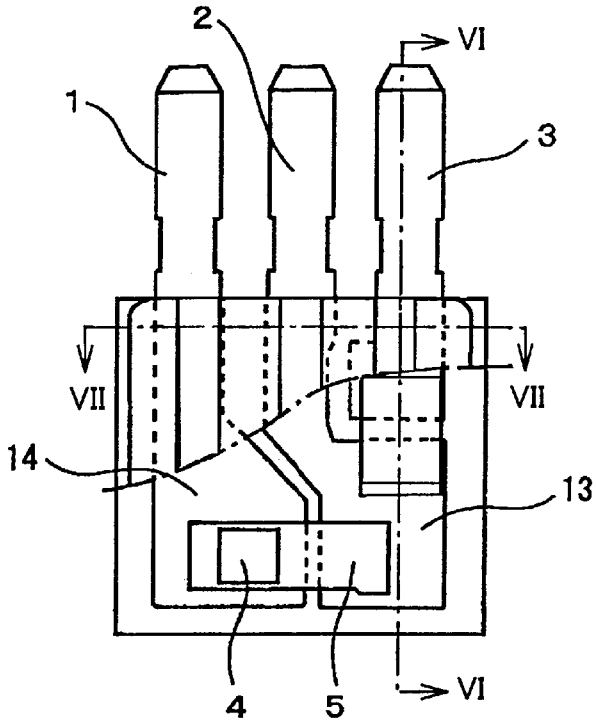
FIG. 4 is a plan view of a functional connector of the present invention.
Figure 6:
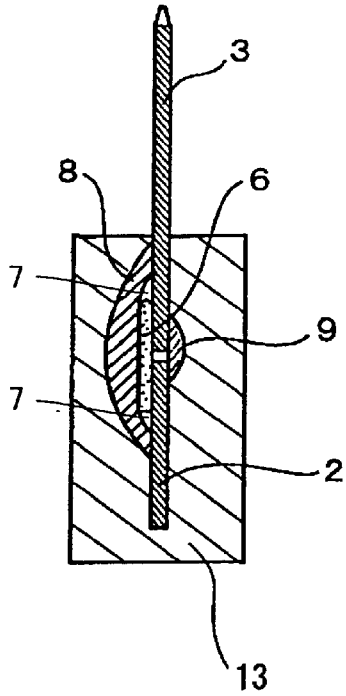
FIG. 6 is a cross section of the FIG. 4 connector taken along a line VI—VI.
Figure 5:
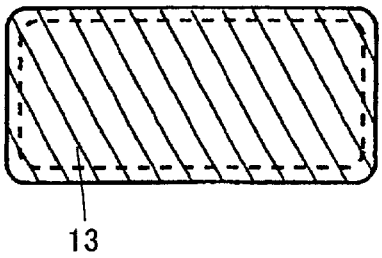
FIG. 5 shows the FIG. 4 connector as seen upwards.

Reference will initially be made to FIGS. 1–3 to describe a method of fabricating a functional connector in accordance with the present invention.

The present functional connector includes three lead frames arranged in parallel and connected by a carrier 11 and a tie bar 12. These three lead frames are denoted as first, second and third lead frames 1, 2 and 3.

A diode chip 4 are connected by a lead chip 5 to the first and second lead frames 1 and 2. Lead chip 5 has an upper portion covered with a buffer material 10.

A resistor chip 6 is firmly adhered to the second and third lead frames 2 and 3 with high-temperature solder 7, e.g., lead-free solder. Resistor chip 6 has an upper portion covered with a buffer material 8 and a gap between the second and third lead frames 2 and 3 is also provided with a buffer layer 9.

Furthermore, the first to third lead frames 1–3 each have a terminal exposed, and diode chip 4, resistor chip 6 and the portions of the lead frames that bear the chips are integrally molded with resin 13.

After they are integrally molded with resin, carrier 11 and tie bar 12 are punched off and thus removed to provide a functional connector serving both a diode connector and a resistor connector.

Reference will now be made to FIGS. 4–7 to describe an example of the functional connector of the present invention. Note that in FIG. 4, molded resin 13 is shown partially eliminated for the sake of convenience to show diode chip 4 and resistor chip 6 provided astride the lead frames.

The first lead frame 1 bearing diode chip 4 and the second lead frame 2 that are maximized in area, as spatially permitted, effectively help to dissipate heat generated from diode chip 4. Resistor chip 6 hardly generates heat and the third lead frame 3 may thus be smaller in area than the first and second lead frames 1 and 2.

Furthermore in connecting the functional connector for example to a control unit in circuit the first and third lead frames 1 and 3, serving as terminals, are alone required to each have a portion exposed outside resin 13, although the center, second lead frame 2 as a dummy terminal that also partially protrudes outside resin 13 can effectively help more to dissipate heat generated from diode chip 4.

It is known that by providing a buffer layer between the resistor chip and the molded resin, thermal stress can be absorbed and a functional connector impervious for example to a cryogenic cycle can be obtained. By also having a buffer layer between the diode chip and the molded resin, the functional connector can further be impervious for example to the cryogenic cycle. Furthermore if the buffer layer is formed of elastic resin having good thermal conductivity it helps to dissipate heat generated from the diode chip and thus allows the functional connector to be more reliable.

While the material that is molded can for example be a typically used epoxy resin, for example devising a filler to provide a blend having good thermal conductivity is preferable as such can helps to dissipate heat generated from the diode chip.

Furthermore, the mold that is formed to have a surface with a depression and a protrusion referred to as a fin, rather than a flat surface, can also help to dissipate heat generated from the diode chip. In the FIG. 4 example, resin 13 has an upper surface provided with a fin.

The diode and resistor chips are firmly fixed or connected to the lead frames preferably with Sn—Ag-based solder, Sn—Ag—Cu-based solder or the like having a melting point of 200 to 240 degrees.

This can satisfy thermal resistance (of 250 degrees centigrade) of a resistance chip and also eliminate the concern that heat (of 200 degrees centigrade) generated from the diode chip may also result in defective connection.

The present functional connector thus includes: first, second and third lead frames each including a contact and a terminal integrally contiguous to the contact; a diode chip; a lead chip posed between the first lead frame and the second lead frame to connect opposite poles of the diode chip to the contact of each of the first lead frame and the second lead frame; a resistor chip arranged astride the second lead frame and the third lead frame and connected to the contact of each of the second lead frame and the third lead frame; and resin covering the first lead frame and the third lead frame each excluding the contact, the diode chip and the resistor chip, with the first lead frame and the third lead frame each having the terminal protruding externally, so that the functional connector can be compact and also functionally serve as both a diode connector and a resistor connector Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A functional connector comprising:

first, second and third lead frames each including a contact and a terminal integrally contiguous to said contact;

a diode chip;

a lead chip posed between said first lead frame and said second lead frame to connect opposite poles of said diode chip to said contact of each of said first lead frame and said second lead frame;

a resistor chip arranged astride said second lead frame and said third lead frame and connected to said contact of each of said second lead frame and said third lead frame; and resin covering said first lead frame and said third lead frame each excluding said contact, said diode chip and said resistor chip, with said first lead frame and said third lead frame each having said terminal protruding externally.

2. The functional connector of claim 1, wherein said first lead frame and said second lead frame are each greater in area than said third lead frame.

3. The functional connector of claim 1, wherein said first lead frame and said third lead frame each have said terminal protruding outside molded resin and in addition said second lead frame has said terminal serving as a dummy terminal and protruding outside said molded resin.

4. The functional connector of claim 1, wherein said molded resin is finned.

5. The functional connector of claim 1, wherein said molded resin is resin having high thermal conductivity.

6. The functional connector of claim 1, wherein a buffer layer formed of elastic resin is provided between said diode chip and said molded resin and between said resistor chip and said molded resin.

* * * * *